US008147000B1

(12) United States Patent
Drake

(10) Patent No.: US 8,147,000 B1
(45) Date of Patent: Apr. 3, 2012

(54) VARIABLE-PRESSURE LUMBAR AND BACK SUPPORT CUSHION

(76) Inventor: Terry G. Drake, Marysville, CA (US)

( * ) Notice: Subject to any disclaimer, the term of this patent is extended or adjusted under 35 U.S.C. 154(b) by 83 days.

(21) Appl. No.: 12/800,282

(22) Filed: May 11, 2010

(51) Int. Cl.
*A47C 7/02* (2006.01)
*A47C 31/00* (2006.01)
*A47C 4/54* (2006.01)

(52) U.S. Cl. ..... 297/452.41; 297/219.1; 297/284.6; 297/DIG. 3

(58) Field of Classification Search ..... 297/452.41, 297/284.6, 226, 219.1, 228.13, 228.12, DIG. 3; 5/655.3, 654
See application file for complete search history.

(56) References Cited

U.S. PATENT DOCUMENTS

RE24,805 E * 3/1960 Morrill, Jr. ..... 297/226
3,112,956 A * 12/1963 Schick et al. ..... 297/219.1
3,253,861 A * 5/1966 Howard ..... 297/452.43
3,276,047 A * 10/1966 Emery ..... 5/654
4,115,885 A * 9/1978 Davis ..... 5/654
5,662,384 A * 9/1997 O'Neill et al. ..... 297/452.41
2004/0232756 A1 * 11/2004 Lin ..... 297/452.41

* cited by examiner

*Primary Examiner* — Milton Nelson, Jr.
(74) *Attorney, Agent, or Firm* — Heisler & Associates

(57) ABSTRACT

The cushion includes a seat and a back separated from each other by a seat-sacral hinge to define two separate air fillable spaces. Separate fill port tubes are provided for filling and adjusting level of fill within the seat and back of the cushion. Weld lines are provided within the seat to define separate chambers within the seat but which are joined together by a common manifold. Weld lines within the back of the cushion divide the back into a sacral/hip space and a sacral/lumbar/kidney space, as well as various back chambers above the sacral/lumbar/kidney space. The cushion includes webs that support dowel pockets that receive dowels for removable attachment of the cushion to an underlying chair. As an alternative, the cushion can be built into the chair.

15 Claims, 3 Drawing Sheets

VARIABLE-PRESSURE LUMBAR AND BACK SUPPORT CUSHION

FIELD OF THE INVENTION

The following invention relates to cushions for seats and other structures adapted to support a user in a sitting position. More particularly, this invention relates to seat cushions which are of an air filled variety with multiple spaces at least partially separated from each other within the air filled seat cushion.

BACKGROUND OF THE INVENTION

Sitting discomfort can be caused by a variety of different conditions. One common condition that is at least a contributory cause if not a primary cause to sitting discomfort is the existence of excessive pressure on portions of the user's body while in a seated posture resting upon a seat or other underlying sitting support structure.

The pressure associated with a user sitting upon a seat has two basic components including the force component and the area component. The greater the force the greater the pressure will be. The lesser the area over which the force is applied, the greater the pressure will be. The force component of this pressure is typically primarily caused by the force of gravity acting on the mass of the user tending to pull the user down toward the Earth. This force is resisted by the seat or other underlying sitting support structure with resultant pressure being felt by the user through nerves in the user's body proportional to this force.

As the force of gravity is substantially constant on the Earth, the primary factor in calculating this gravity force is the mass of the user. While in a seated position it is primarily the mass of the torso, head and arms of a user, as well as to some extent the mass of the hips and upper legs of the user, which are the portion of the mass of the user which contribute to the force component of pressure experienced by the user. Because users often have little control over their body mass, it is typically difficult or impractical to minimize pressure associated with sitting by reducing the force being exerted by gravity on the user and resisted by the underlying sitting support structure.

The area over which this force acts is the second parameter that establishes the pressure felt by the user. In particular, as the area over which this force acts is increased, the pressure experienced is decreased. Pressure is typically not uniform within the area that the force applies. Furthermore, the overall dimensions of the user restrict to some extent the maximum amount of area available for distribution of this force. Typical seat cushions provide some degree of padding so that the forces are distributed somewhat over a larger area rather than being concentrated at small areas or points beneath the user. However, cushions generally only act to a relatively small extent in distributing these forces. In particular, as a solid structure, cushions exhibit a limited amount of movement and thus only modify associated pressures partially.

It is known in the prior art to utilize air filled cushions as a sitting aide in certain circumstances. For instance, hemorrhoid donuts are known in the prior art which are partially inflated and then the user sits upon such a structure. With such air filled cushions, generally upper and lower layers of substantially air tight material are provided surrounding an interior space. The air cushion is filled sufficiently so that the upper and lower layers do not come into contact with each other. The air filled cushion automatically alters it geometry to conform to that of the user typically to a greater extent than soft material cushions. Thus, a higher degree of force distribution over the area involved is achieved.

Prior art air filled cushions have not been entirely satisfactory for a variety of reasons. First, the geometry of a user when seated in an upright manner is not a simple geometry. Thus, merely providing a cushion beneath the underside of the user is often insufficient to effectively distribute forces sufficient to avoid pain for the user. This is particularly true when the user experiences lower back pain and pain about the hips of the user.

Secondarily, air cushions have a tendency to provide too much movement between the user and the underlying sitting support structure. It is generally desirable when a user is utilizing a sitting support structure that the user be able to remain substantially still when seated. If the user must "balance" upon the cushion in a manner similar to balancing upon an air filled large ball, the user will be subconsciously tensioning and relaxing a variety of different muscles to maintain a desired posture. While such "exercise" may be beneficial for short durations, over a long period of sitting, such muscle activity soon leads to muscle fatigue and enhanced discomfort for the user.

When the underlying sitting support structure is a seat of an automobile, additional forces are being applied on the user associated with bumps in the road and acceleration around corners or in a forward or backward direction during acceleration and braking. Prior art air filled seat cushions have either failed to provide an adequate degree of immobility to keep the user comfortably seated in a single position, or have provided too little cushioning support so that concentrations of force occur within the area over which the pressure is experienced, so that pressure points still exist at which excessive forces lead to pain and other discomfort for the user. Accordingly, a need exists for an improved lumbar and back support cushion which can not only support upper legs of the user but also the lower back and upper back of the user in a manner both effective to provide a comfortable and secure body position for the user but also minimize force concentrations.

SUMMARY OF THE INVENTION

This invention reduces and eliminates this discomfort and sensitization in three ways. First, this invention provides four-zone cushioning to separately support the seat, the sacral/hip area, the sacral/lumbar/kidney region and the full extent of the remaining back area, including the shoulders. Only the seat is separately inflated. Because of the cushion's unique geometry, support for each of the remaining zones is a function of the volume of air introduced.

Second, this invention provides novel configuration that provides a continuous perimeter that limits side motion by drawing up around the user the deeper the cushion is dished by roll, pitch or yaw thrusting. It also provides seamless, single chamber cushioning for the sacral, hip, lumbar, kidney and back areas with the least possible inflated volume. It also permits smooth, personalized variation and balance of cushioning for these areas, using air volume alone, with no additional chambering, valving or plumbing. It also enables the cushion to be used for a variety of body types and sizes, on a variety of seat types and configurations.

Third, to further reduce or eliminate possible sensitivity issues, this invention provides anchorage to attach or otherwise incorporate a variety of active and passive coverings to the cushion.

This invention can be configured either for an OEM (Original Equipment Manufacturer) or a separate cushion for after market applications. Versions of the OEM type are custom designed for installation in, or as adjunct to, specially designed seating systems. The after market type is provided in a variety of configurations for use with seats available from other manufacturers, for instance in cars or other vehicles, furniture, etc.

The cushion is constructed in the manner usual for inflatable cushions and mattresses, with two sheets of plastic material cut to a specified pattern and welded together along prescribed joining lines. The cushion is provided in a range of sizes in two main configurations. The after market version is used as optional extra cushioning for a variety of existing seats that may readily be used without the cushion. The OEM version is specifically designed as a component of a particular or limited variety of seats, which are manufactured to incorporate or accommodate the OEM cushion.

The after market version also has a perimeter flange designed to attach upholstery material, and any padding that may be used to cover the cushion. The flange is specifically designed for binding, that is covering the raw edges of upholstery and padding and the cushion itself, by sewing or other permanent or temporary means.

The OEM version may be provided in one or more sectional pieces, with tabs, ties and flanges custom designed for specific applications. Whether OEM or after market, each cushion has one or more filler tubes attached through which separate chambers of the cushion are inflated or deflated. Internal pressures are low enough that average persons are capable of inflating the cushion using only their breath. In simpler configurations, one tube is provided for the seat and another for the back. In more complex arrangements, one filler tube may be supplied with a valve through which either the seat or the back may be filled or evacuated. On all breath-filled cushions, a standard commercially available fill-release mouthpiece automatically retains pressure, or enables the operator to increase or release the cushion's internal pressure.

After market cushions may be supplied as breath or pump filled only or as combination breath and pump filled. OEM cushions are usually provided with a mechanical or electrical operated pump. High end and custom OEM cushions may be supplied with more elaborate, automatic or programmable pumps and pressure regulators. Any version of the cushion may be provided with manually or automatically controlled heating, cooling or ventilating upholstery covering.

OBJECTS OF THE INVENTION

Accordingly, a primary object of the present invention is to provide a seat cushion which can rest upon an underlying sitting support structure to support a user resting upon the cushion in a manner which supports the user while minimizing pain and discomfort.

Another object of the present invention is to provide an air filled seat cushion which has a variable amount of air contained therein.

Another object of the present invention is to provide an air filled seat cushion which can be used upon a variety of different seats or other underlying sitting support structures.

Another object of the present invention is to provide a cushion which can either be built into an underlying sitting support structure or rest upon underlying sitting support structure.

Another object of the present invention is to provide a cushion which provides a degree of support at the sacral/hip area and sacral/lumbar/kidney area of a user sufficient to minimize force concentration and associated pain on these areas of the user's body.

Another object of the present invention is to provide a cushion which both conforms to a user's anatomy and also provides a high degree of stability to the user resting upon the cushion.

Other further objects of the present invention will become apparent from a careful reading of the included drawing figures, the claims and detailed description of the invention.

BRIEF DESCRIPTION OF THE DRAWINGS

FIG. 2 is over inflated to help identify and show relative extensions available for these areas.

DESCRIPTION OF THE PREFERRED EMBODIMENT

Figure 1:
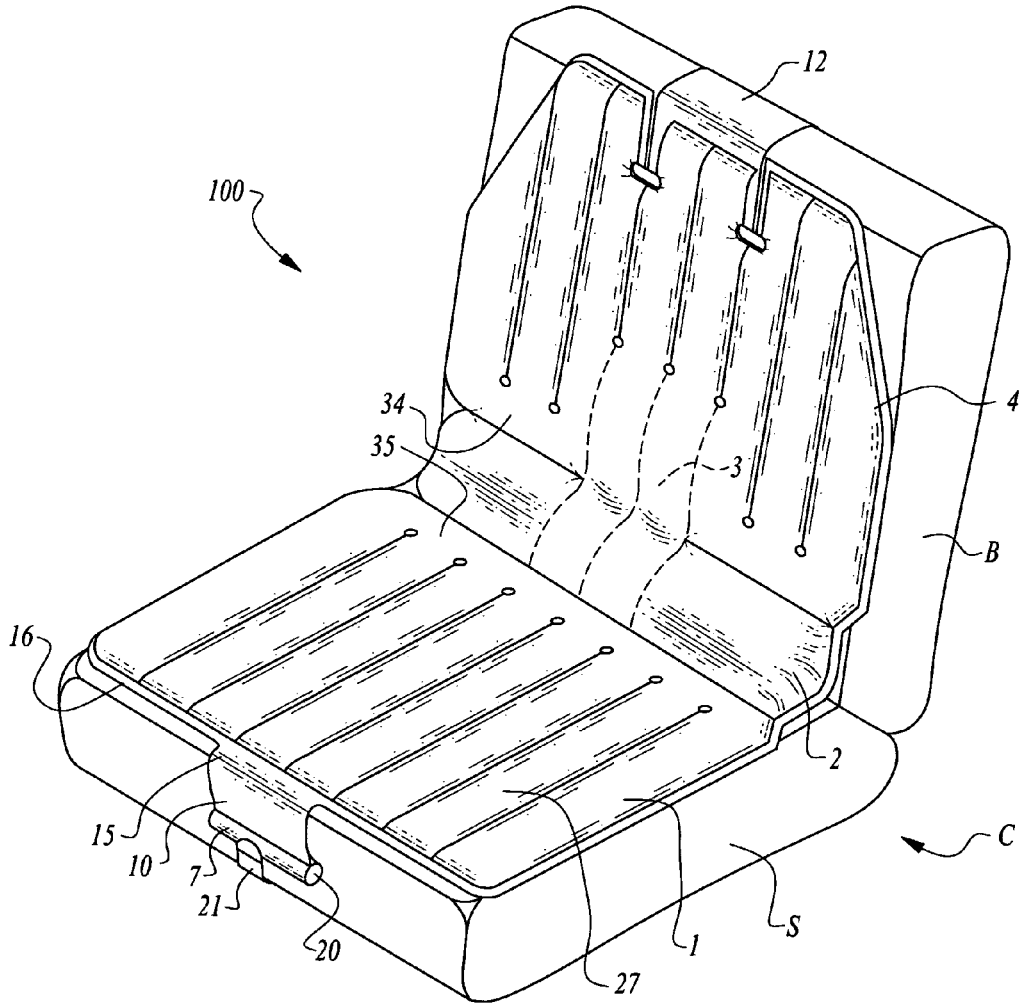
FIG. 1 is a perspective view of the cushion of this invention in its usual under inflated state attached to a typical seat. The dotted lines show the surface contours of the critical sacral/lumbar/kidney support area. This area is shown over inflated to demonstrate the range of support available.

Referring to the drawings, wherein like reference numerals represent like parts throughout the various drawing figures, reference numeral 100 is directed to a cushion usable upon a chair C or other underlying sitting support structure for both back support through a back portion B (FIGS. 1 and 4) and leg support through a seat portion S of the chair C. The cushion 100 features a pair of walls formed of substantially air impermeable material joined together at a perimeter thereof and selectively joined together at other locations to form a seat 1 portion of the cushion 100 and a back 4 portion of the cushion 100. Importantly, a sacral/hip space 2 and a sacral/lumbar/kidney space 3 are also configured into portions of the back 4 to maximize surface area contact for minimization of force concentrations and comfortably supporting the user U upon this chair C or other underlying sitting support structure, when utilizing the cushion 100.

Figure 4:
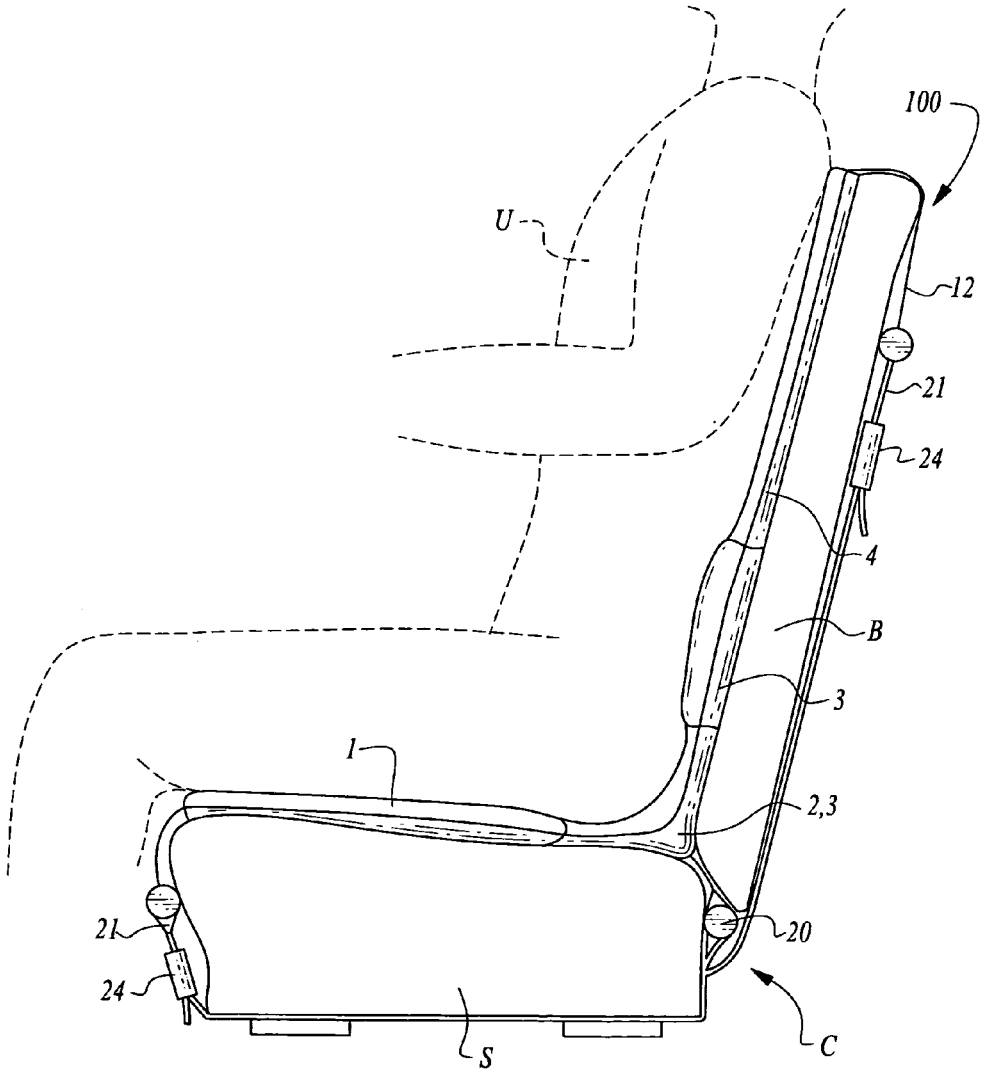
FIG. 4 is a side full cross-section view showing typical under inflation, the cushion's chambers fold together to provide full surface contact and eliminate all pressure points and irritation zones.

In essence, and with particular reference to FIG. 1, basic details of the cushion 100 are described. The cushion 100 includes the seat 1, adapted to reside upon a seat portion S of the chair C (FIGS. 1 and 4). A back 4 of the cushion 100 is provided adapted to be located adjacent a back portion B of the chair C. This back 4 includes a sacral/hip space 2 at a lowermost portion thereof and a sacral/lumbar/kidney space 3 at a vertically and laterally centralized location within the back 4 portion of the cushion 100.

The seat 1 is separated from the back 4 by a seat-sacral hinge 5 which preferably completely isolates an interior of the seat 1 from an interior of the back 4. A sacral-back hinge 6 is provided between the sacral/hip space 2 and the sacral/lumbar/kidney space 3. The sacral-back hinge 6 does not entirely isolate the sacral/hip space 2 from the sacral/lumbar/kidney space 3, but rather an opening is provided at a central portion of the sacral-back hinge 6 to allow air migration between the sacral/hip space 2 and the sacral/lumbar/kidney space 3. A seat fill port tube 18 and back fill port tube 19 (FIGS. 2 and 3) facilitate the input or removal of air into or out of the seat 1 and/or back 4 to fine tune a level of fill to adapt to particular user U anatomy, and a particular user U body mass.

Preferably, three points of attachment means are provided to secure the cushion 100 to an underlying chair C or other underlying sitting support structure. These attachment means are most preferably in the form of a series of webs (FIGS. 2 and 3) including a front pocket web 10, rear pocket web 11 and top pocket web 12, each supporting a pocket including the front dowel pocket 7, rear dowel pocket 8 and top dowel pocket 9. A dowel 20 can pass through each of these pockets 7, 8, 9 (FIGS. 3 and 4) and then be secured, such as through a hold down strap 21 and associated buckles 24 (FIGS. 2 and 4) to complete the attachment means. As an alternative, the entire cushion 100 could be built integrally into the chair C or other underlying sitting support structure.

Most preferably, the cushion 100 is further isolated from the user U through a foam layer or fabric layer, primarily to provide a layer of insulation to regulate heat transfer to and from the user U in a manner generally similar to that experienced when sitting upon standard cushions formed of solid material. Such a fabric or solid foam layer is not shown in the drawings to most clearly illustrate the important unique details of this invention but could be provided as a layer of foam rubber of various different thicknesses, or a fabric layer of various different thicknesses, or conceivably some other material such as wool, cotton or synthetic fibers of varying thicknesses and formed through techniques known in the art.

Figure 2:
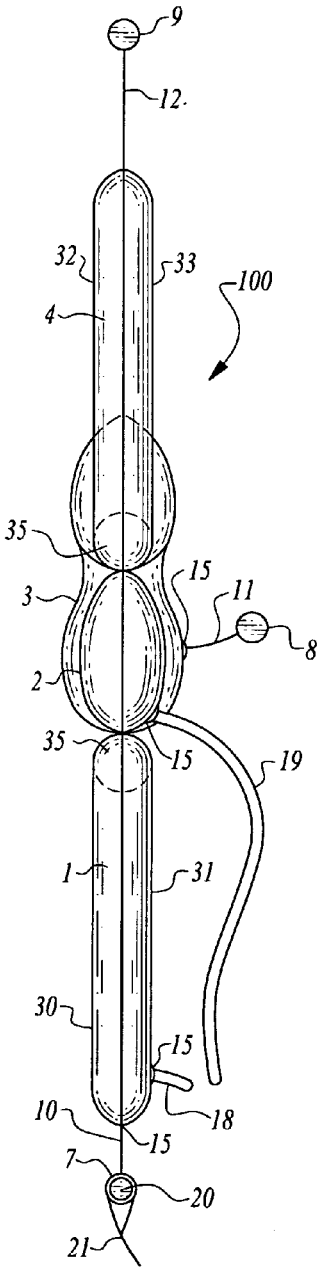
FIGS. 2 and 3 show the side and back views respectively of the cushion positioned with a seat portion rotated to a plane common with the back portion.

More specifically, and with continuing reference to FIGS. 1-4, specific details of the various different portions of the cushion 100 are described. With regard to the seat 1, the seat 1 is formed of a top wall and a bottom wall spaced from each other by a seat interior space. These walls are all joined together at perimeters thereof to fully enclose this space within the seat 1. A rear edge of the seat 1 is defined by the seat-sacral hinge 5 which is adjacent the back 4 portion of the cushion 100. Other perimeter portions of the seat 1 are typically formed merely by welding or otherwise bonding the top wall and bottom wall of the seat 1 together along a full perimeter band 16. A forward portion of the seat 1 opposite the seat-sacral hinge 5 preferably supports one of the pockets in the form of the front pocket web 10 supporting a front dowel pocket 7 and bonded to the seat 1 through an attachment bond 15 (FIG. 2). These attachment bonds 15 can utilize adhesive or some form of heat welding procedure. Typically, the attachment bonds 15 would be similar for the full perimeter bond 16 as for the attachment bond 15 joining the front pocket web 10 to the seat 1.

Figure 3:
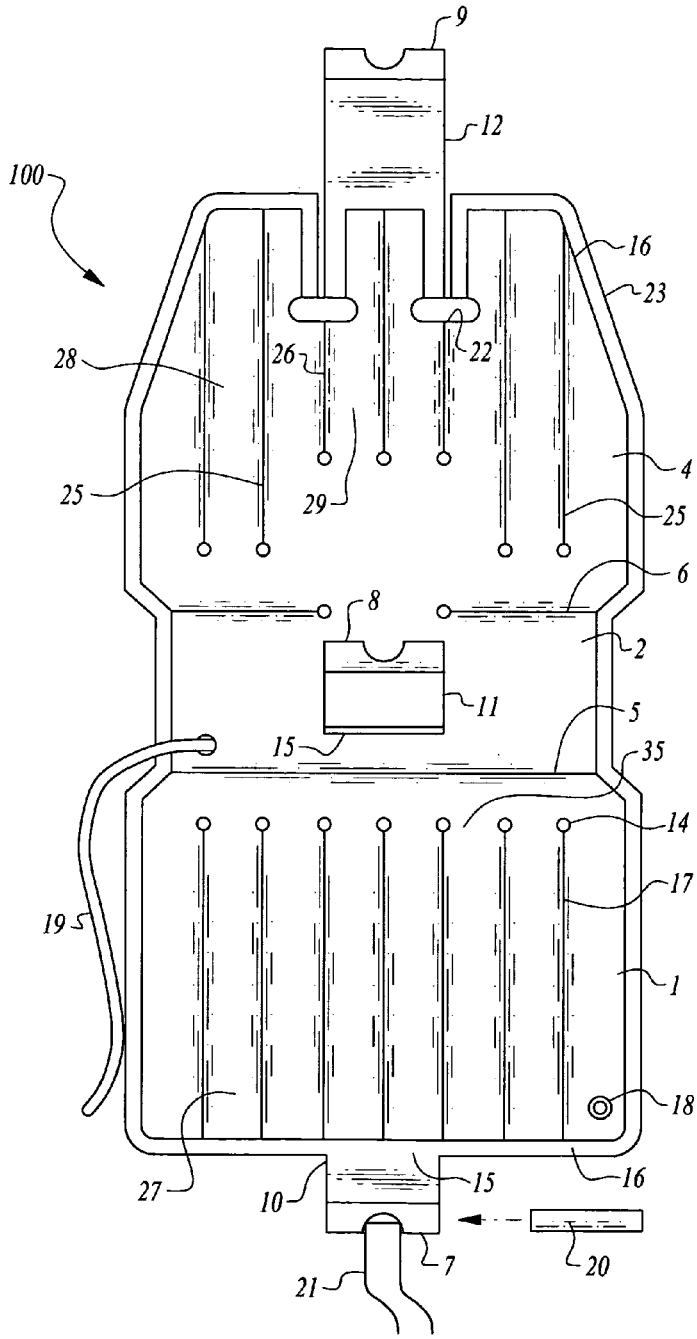

Most preferably, an interior of the seat 1 is also provided with bonded portions which bond the top wall to the bottom wall in the form of seat weld lines 17 (FIG. 3). In the embodiment shown, seven such weld lines 17 are provided. These weld lines 17 preferably extend linearly from the front of the seat 1 toward the seat-sacral hinge 5, stopping short of the seat-sacral hinge 5 so that a seat manifold space 35 is provided joining separate seat chambers 27 together.

Ends of these seat weld lines 17 are preferably provided with strain relief 14 at terminal ends thereof. This strain relief 14 is preferably similar for each weld line on various different portions of the cushion 100. In particular, the strain relief 14 is an area where the top and bottom walls are welded or otherwise bonded together. This area is preferably substantially circular and has a width greater than that of the weld lines. In a typical application where the seat is approximately two feet wide, the weld lines 17 might typically be provided between 3/16 and 1/4 inch wide and with the strain relief 14 areas having a diameter of approximately 3/4 to 7/8 inch in diameter.

Most preferably, the full perimeter bond 16 does not define the absolute edge of the seat 1. Rather, preferably additional material forming at least a portion of one of the top wall or the bottom wall extends slightly beyond this full perimeter bond 16. Such additional material is thus available as a flange 23 (FIG. 3) which can be utilized for fastening or other attachment to adjacent structures, especially when sewn into a chair C or sewn to foam rubber or other fabrics primarily for comfort and heat transfer means as additional layers added to the cushion 100.

The seat fill port tube 18 preferably is bonded to the seat 1 within one of the most lateral seat chambers 27 with an attachment bond 15 surrounding the seat fill port tube 18. This seat fill port tube 18 preferably extends slightly away from the seat 1 to some form of air input junction. This air input junction could merely be an end which a user can insert into the user's mouth for blowing air into the space within the seat 1. As an alternative or in conjunction, a manually actuatable pump could be utilized such as a bulb which can be repeatedly squeezed by a hand of a user, or a foot pedal which can be sequentially manipulated by a foot of the user to pump air into the interior of the seat 1. As another alternative, an electric pump can be provided to pump air into the seat fill port tube 18.

Preferably, a valve is provided which keeps air moving preferentially into the interior of the seat 1 rather than out of the seat 1, but which can be adjusted to release air out of the seat 1 interior when it is desired to remove air from the seat 1. Typically, a user U will sit upon the seat 1 and then utilize the seat fill port tube 18 and some means for infill of air into the interior of the seat 1 to add air into the interior of the seat 1 until a desired level of fill and associated comfort is achieved. If too much air is entered into the seat 1, the valve can be actuated to release air from the interior of the seat 1.

As an alternative, a user could specify a weight of the user and the seat 1 could be appropriately calibrated to measure an amount of air within the seat 1 and automatically input or remove air from an interior of the seat 1 to match a predetermined level of fill for a person of that body mass. Such an automatic system could have a manual override for fine tuning adjustment, in addition. Input of the weight of the user could be by providing a scale for automatic detection of the weight of the user U, or by manual input of the user U into some form of input device. A sensor would also be provided to measure the amount of fill within the seat 1. Such a sensor could be a pressure sensor that is highly sensitive to detect the pressure within the seat 1 being sat upon by the user U. As another alternative, some degree of fill within the seat 1 could be measured, such as by a linear displacement transducer which measures a distance between the top wall and bottom wall of the seat 1 and, with appropriate calibration, interrelates such measured data into a measurement of the amount of fill within the seat 1.

Through experimentation, a baseline of appropriate level of fill for different body masses could be established and contained within a look up table or within some form of formula which could be operated by a computational device so that the seat 1 would automatically always have an optimal amount of air fill within an interior of the seat 1 for optimal comfort and support.

With continuing reference to FIGS. 1-4, details of the back 4 of the cushion 100 are described. While the back 4 could conceivably be provided alone without the seat 1, the back 4 is preferably provided along with the seat 1 as portions of the cushion 100 above the seat-sacral hinge 5. The back 4 has a similar configuration to that of the seat 1 in that it is defined by a fillable air space between a front wall and a back wall. The full perimeter bond 16 joins the front and back walls together about the perimeter of the back 4.

The contour of this perimeter of the back 4 is preferably generally rectangular but can be tapered a little bit at upper corners, such as to conform somewhat to the contour of a chair C, such as a car seat that might taper towards an upper end thereof. The geometry of the back 4 could be customized to match that of a particular chair C with which the cushion 100 is configured to be used. Importantly, the back 4 is configured not only to support planar upper portions of a back of a user U, but also to support mid-body lower back and hip portions of the user U which often are least properly supported by the chair C alone or other prior art cushioning devices. In fact, a simplified embodiment of the invention could include the back 4 without the seat 1 and/or without upper portions of the back 4, but rather to support only the hip portions and the mid-body lower back of the user U.

Upper portions of the back 4 are secured to the back portion B of the chair C, such as through a top pocket web 12 extending up from an upper portion of the back 4 to a top dowel pocket 9. A top web strain relief 22 can be provided which provides a large surface area for attachment of the top pocket web 12 such that the relatively high forces that can be encountered between the top pocket web 12 and the back 4 can be appropriately distributed and prevent tearing or ripping of material forming the back 4. Most preferably, these top web strain reliefs 22 are provided below an upper edge of the back 4 within slots that extend vertically down into the back 4 slightly, to provide for the geometry of some car seats which include a headrest which is adjustable within such a space, and might require openings for headrest support structures.

An interior of the back 4 is generally divided into a sacral/hip space 2 and a sacral/lumbar/kidney space 3. Also, upper portions of the back 4 are preferably provided in the form of long lateral back chambers 28 and short central back chambers 29 which extend vertically up from the sacral/lumbar/kidney space 3. These various spaces 2, 3, 28, 29 are defined by various different web lines extending between the front wall and back wall of the back 4.

In particular, a sacral-back hinge 6 is provided extending substantially horizontally from lateral edges of the back 4 toward a center point between the sacral/hip space 2 and the sacral/lumbar/kidney space 3. These sacral-back hinge 6 weld lines do not extend all the way together. Rather, they stop at strain reliefs 14 similar to those described above within the seat 1. An opening is thus provided for passage of air between the sacral/hip space 2 and the sacral/lumbar/kidney space 3. This opening importantly causes pressure and an amount of "fill" within the sacral/hip space 2 and the sacral/lumbar/kidney space 3 to be similar to each other. As air is added to the back 4, these separate spaces 3, 4 provide additional support to the user U, in a substantially proportionate manner. This avoids the need to separately adjust separate portions of the back 4.

Otherwise, the sacral/hip space 2 does not include any weld lines therein. Thus, this sacral/hip space 2 will tend to balloon under air pressure forces to pursue the most bulbous contour possible except to the extent compressed by lower body structures of the user U (FIG. 4). Such bulging of the sacral/hip space 2 is perhaps slightly greater adjacent a vertically extending midline thereof, due to the presence of the opening between the strain reliefs 14 at the ends of the sacral-back hinge 6. Such additional bulging can provide further support adjacent a tailbone of the user U.

Upper portions of the back 4 include multiple long lateral back weld lines 25 and short central back weld lines 26 extending down from an upper edge of the back 4 toward the sacral-back hinge 6, but stopping short of the sacral-back hinge 6. The long lateral back weld lines 25 cause long lateral back chambers 28 to be defined. The short central back weld lines 26 cause short central back chambers 29 to be defined inboard of the long lateral back chambers 28.

Because the short central back chambers 29 are shorter than the long lateral back chambers 28, the sacral/lumbar/kidney space 3 is defined inboard of the long lateral back chambers 28 and above the sacral-back hinge 6, and below ends of the short central back chambers 29. This sacral/lumbar/kidney space 3 is a region substantially free of weld lines and so bulges out greater than other portions of the back 4 lateral to and above the sacral/lumbar/kidney space 3, in a manner similar to the sacral/hip space 2. Thus, additional pressure and support can be provided adjacent the sacral/lumbar/kidney portions of the body of the user U. A seat manifold space 35 is provided joining the long lateral back chambers 28 to the short central back chambers 29 and to the sacral/lumbar/kidney space 3, so that air can move freely between these chambers. Such movement will occur as the user U body moves position and to conform to the particular geometry and anatomy of the user U.

Furthermore, as the degree of concentration of weld lines varies, the degree to which the back 4 naturally bulges will vary at different locations to provide enhanced pressure and support where needed and to provide lesser pressure and support where needed. Through experimentation, applicant has determined that the particular configuration of weld lines, chambers and spaces within the back 4 has been optimized to provide the requisite amount of support to comfortably allow the user U to sit upon a chair C for exceptionally long periods of time in comfort.

In fact, the inventor's own experience with a prototype of this invention including this configuration shown in the preferred embodiment of FIGS. 1-4 has shown exceptional results. The positions of weld lines and slopes of spaces, especially within the back 4 have been adjusted through extensive experimentation to arrive at the configuration shown herein, which delivers optimum performance. For instance, the sacral/hip space 2 was originally as wide laterally as other portions of the back 4 and seat 1. Through experimentation, it was discovered that narrowing the sacral/hip space 2 (see FIG. 3) significantly improved support in the sacral/hip space 2. The inventor has significant low back pain when standing, and when sitting without the cushion 100 of this invention. When utilizing the cushion 100 of this invention, either when driving a car or sitting in a chair away from an automobile, the requisite amount of support has been provided so that the user U can be in a sitting posture for many hours or even an entire day, without experiencing pain. As inventor's body geometry is rather typical, similar results are anticipated for the anatomy of many other users, especially when accommodating body mass and other particular needs of other users by adjusting air pressure within the seat 1 or back 4.

To achieve optimal air pressure within the back 4, a back fill port tube 19 is utilized which interfaces with the sacral/hip space 2 and hence the entire interior of the back 4, through an attachment bond 15. As described above with conjunction with the seat 1, some form of filing means is also accommodated, such as blowing by the user, utilizing of a manual pump or utilization of an electric pump, either with manual adjustment to suit the user's needs or through some type of control device which measures body mass and/or degree of fill and then adjusts fill accordingly for optimal comfort, and which can be fine tuned thereafter by the user optionally.

The back 4 is furthermore supported upon the chair C through utilization of the rear dowel pocket 8 at the end of the rear pocket web 11 attached through a rear dowel pocket bond to portions of the sacral/hip space 2 on the back wall of the back 4, such as through a further attachment bond 15. A dowel 20 can pass through the rear dowel pocket 8 (FIG. 4) and this dowel can reside within a common recess which is provided between a seat portion S and back portion B of many common chairs C. Appropriate buckles 24 and hold down straps 21 can be utilized in conjunction with the dowel 20 associated with the rear dowel pocket 8 in a manner similar to that utilized for the front dowel pocket 7 and top dowel pocket 9 (FIG. 4).

Various different materials can be utilized to form the front, back, top and bottom walls forming the various different portions of the cushion 100. In a preferred form of this invention polyurethane material is utilized. This material can be appropriately flocked both to provide added comfort and for tear resistance, or otherwise treated to minimize tear resistance and for comfort and heat transfer optimization. While various different numbers of weld seams and configurations of weld seams are shown in this preferred embodiment, the number of weld lines could be increased or decreased somewhat and still provide most of the benefits of this invention. Furthermore, the exact lengths and locations of these weld lines and the exact sizes of the strain release at the end of these weld lines could be modified somewhat and still provide some of the benefits of this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. For instance, when structures are referred to as "weld lines" or imply formation by "welding," such a term should be considered to broadly include heat welding, sonic welding, and other processes that include at least partial melting or softening, as well as bonding, such as adhesive bonding to hold the two layers together along the "weld lines," strain reliefs or other such spaces. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A cushion for enhancing support of a person resting upon an underlying sitting support structure, the cushion comprising in combination:

a seat portion;

said seat portion having at least one air filled chamber between a top wall and a bottom wall;

a back portion;

said back portion having at least two air filled chambers between a front wall and a back wall, including a first chamber defined by a sacral/lumbar/kidney space above a second chamber defined by a sacral/hip space and at least partially positioned and configured to allow air to flow between said sacral/lumbar/kidney space and said sacral/hip space;

said back portion joined to said seat portion at a rear side of said seat portion and a lower end of said back portion;

means to fill and control level of fill within said back portion;

wherein said back portion includes a plurality of additional chambers above said sacral/lumbar/kidney space, said additional chambers in said back portion at least partially open to said sacral/lumbar/kidney space; and wherein said chambers in said back portion above said sacral/lumbar/kidney space include both long lateral chambers and short central chambers, with said short central chambers between multiple said long lateral chambers.

2. The cushion of claim 1 wherein a sacral back hinge is provided joining said front wall and said back wall of said back portion together between said sacral/lumbar/kidney space and said sacral/hip space.

3. The cushion of claim 1 wherein said means to fill and control level of fill within said back portion includes a fill tube coupled to a source of air and to an interior of said back portion, and with a valve along a portion of said tube adapted to control flow through said tube.

4. The cushion of claim 3 wherein said fill tube is adapted to allow a user to blow air into said back portion through said fill tube.

5. The cushion of claim 3 wherein an electric air pump is coupled to said fill tube and configured to drive air into said back portion when said electric pump is actuated.

6. The cushion of claim 1 wherein said long lateral chambers and said short central chambers are divided from each other by weld lines joining said front wall and said back wall of said back portion together.

7. The cushion of claim 6 wherein said weld lines dividing said long lateral chambers and short central chambers from each other extend substantially vertically and substantially perpendicular to a sacral back hinge.

8. The cushion of claim 6 wherein said weld lines dividing said long lateral chambers and said short central chambers from each other, and sacral back hinges each include ends with strain relief areas thereon, said strain relief areas being wider than said weld lines and said sacral back hinge.

9. The cushion of claim 8 wherein said strain relief areas are defined by a substantially circular area joining said front wall to said back wall.

10. The cushion of claim 1 wherein a means to attach said cushion to the underlying sitting support structure is included with said cushion.

11. A cushion for enhancing support of a person resting upon an underlying sitting support structure, the cushion comprising in combination:

a seat portion;

said seat portion having at least one air filled chamber between a top wall and a bottom wall;

a back portion;

said back portion having at least two air filled chambers between a front wall and a back wall, including a first chamber defined by a sacral/lumbar/kidney space above a second chamber defined by a sacral/hip space and at least partially positioned and configured to allow air to flow between said sacral/lumbar/kidney space and said sacral/hip space;

said back portion joined to said seat portion at a rear side of said seat portion and a lower end of said back portion;

means to fill and control level of fill within said back portion;

wherein a sacral back hinge is provided joining said front wall and said back wall of said back portion together between said sacral/lumbar/kidney space and said sacral/hip space; and wherein said sacral back hinge includes two colinear portions spaced apart by a central opening therein, said central opening allowing air to flow between said sacral/lumbar/kidney space and said sacral/hip space.

12. A cushion for enhancing support of a person resting upon an underlying sitting support structure, the cushion comprising in combination:

a seat portion:

said seat portion having at least one air filled chamber between a top wall and a bottom wall;

a back portion;

said back portion having at least two air filled chambers between a front wall and a back wall, including a first chamber defined by a sacral/lumbar/kidney space above a second chamber defined by a sacral/hip space and at least partially positioned and configured to allow air to flow between said sacral/lumbar/kidney space and said sacral/hip space;

said back portion joined to said seat portion at a rear side of said seat portion and a lower end of said back portion;

means to fill and control level of fill within said back portion; and wherein said seat portion includes a plurality of separate chambers separated by weld lines therebetween, said weld lines joined to a perimeter of said seat portion at one end and terminating at strain relief circles at ends of said weld lines most distant from edges of said seat portion, such that chambers between said weld lines are joined together at a back end of said seat portion adjacent said back portion of said cushion.

13. A back cushion for enhanced back support while sitting, comprising in combination:

a front wall:

a rear wall;

said front wall joined to said rear wall at a perimeter thereof;

said walls formed of a material that is substantially impermeable to passage of gas between an interior between said front wall and said rear wall and an exterior on sides of said front wall and said rear wall opposite said interior;

a sacral/hip space defining a portion of said interior between said front wall and said rear wall, said sacral/hip space adapted to support a sacral/hip area on a body of a user;

a sacral/lumbar/kidney space between said front wall and said rear wall and defining a portion of said interior, said sacral/lumbar/kidney space adapted to support a sacral/lumbar/kidney area of the body of the user;

said sacral/lumbar/kidney space located above said sacral/hip space;

an opening between said sacral/lumbar/kidney space and said sacral/hip space allowing air to pass between said sacral/lumbar/kidney space and said sacral/hip space;

wherein said sacral/lumbar/kidney space is provided as a lower central portion of a larger upper interior space of said back cushion;

wherein a hinge separates said sacral/hip space from said larger upper interior space of said back cushion; and wherein said hinge includes two separate co-linear parts with a gap between said two parts, said sacral/lumbar/kidney space located above said hinge and said sacral/hip space located below said hinge.

14. The back cushion of claim 13 wherein said parts of said hinge are configured as weld lines bonding said front wall to said rear wall with ends of said weld lines adjacent said opening between said sacral/lumbar/kidney space and said sacral/hip space including strain relief areas in the form of substantially circular weld areas where said front wall and said rear wall are welded together.

15. The back cushion of claim 13 wherein said upper interior space of said back cushion includes a plurality of vertical weld lines extending down toward said hinge but stopping short of said hinge by a back manifold space, said vertical weld lines including long lateral back weld lines and short central back weld lines with said short central back weld lines interposed between said long lateral back weld lines, and with each of said vertical weld lines including strain reliefs at lower tips thereof.

* * * * *